United States Patent [19]

Dempf et al.

[11] Patent Number: 4,682,770

[45] Date of Patent: Jul. 28, 1987

[54] OUTPUT DEVICE IN A PRINTING MECHANISM FOR SINGLE DOCUMENTS SEPARATED FROM A PERFORATED CONTINUOUS-FORM PAPER WEB

[75] Inventors: Josef Dempf, Klosterlechfeld; Erich Moser, Taufkirchen, both of Fed. Rep. of Germany

[73] Assignee: Siemens Aktiengesellschaft, Berlin and Munich, Fed. Rep. of Germany

[21] Appl. No.: 820,803

[22] Filed: Jan. 22, 1986

[30] Foreign Application Priority Data

Jan. 25, 1985 [DE] Fed. Rep. of Germany ..... 3502515

[51] Int. Cl.[4] ..... B65H 43/08

[52] U.S. Cl. ..... 271/176; 209/534; 221/12; 271/189; 271/220; 400/625

[58] Field of Search ..... 271/176, 189, 213, 218, 271/220, 207; 209/534; 221/12; 400/625

[56] References Cited

U.S. PATENT DOCUMENTS

| | | | |
|---|---|---|---|
| 3,675,816 | 7/1972 | Bourke | 221/12 X |
| 4,339,119 | 7/1982 | Sasaki | 271/189 X |
| 4,453,870 | 6/1984 | Bean | 271/220 X |
| 4,470,590 | 9/1984 | Ariga | 271/189 X |
| 4,493,484 | 1/1985 | Eyer | 271/220 |
| 4,593,896 | 6/1986 | Nakamura | 271/189 X |

*Primary Examiner*—Richard A. Schacher

*Attorney, Agent, or Firm*—Hill, Van Santen, Steadman & Simpson

[57] ABSTRACT

A collecting stacker for collecting all documents of a user is provided in the printing mechanism preceding the output stacker, whereby a retention mechanism is provided at the output of the collecting stacker, this retention mechanism opening after the arrival of the last document with respect to the individual user and initiating further transport of all documents contained in the collecting stacker into the output stacker in common. Documents left in the output stacker are subsequently transported to a user inaccessible deposit stacker.

7 Claims, 2 Drawing Figures

OUTPUT DEVICE IN A PRINTING MECHANISM FOR SINGLE DOCUMENTS SEPARATED FROM A PERFORATED CONTINUOUS-FORM PAPER WEB

BACKGROUND OF THE INVENTION

1. Field of the Invention

The invention relates to an output device in a printing mechanism for single documents separated from a perforated continuous form paper web where the documents are transported into an output stacker after the printing and parting operation, and the operation of the printing mechanism is enabled by user-associated authorization cards which are insertable into a badge reader.

2. Description of the Prior Art

A preferred area of employment or use of such printing mechanisms is in so-called statement of account printers which, as customer terminals in banks and savings institutions, provide the customer or user, insofar as he possesses an authorization card, for example a magnetic strip-coded checking card, with the opportunity of having the most recent account transactions and, thus, the current value on account printed out on one or more documents. Known statement of account printers function such that the documents are individually output to the customer through an output slot. In this operating mode, however, there is the danger or possibility that the user will only take the first or only some of the documents in the mistaken assumption that the printing event he initiated has been completed, then leaves the device and leaves the last or the remaining documents behind. Apart from the fact that the customer has not received all data appertaining to him, this has the further consequence that the documents which have been left behind can easily be taken by the next user of this device, and thus, fall into someone else's hands.

SUMMARY OF THE INVENTION

It is therefore an object of the present invention to improve an ouput device of the type initially described such that the user has a greater assurance that he will in fact take all documents from the device intended for him.

This object is achieved in accord with the invention by providing a collecting stacker for collecting all documents of a user preceeding the output stacker, and by providing a retention member of the last document with respect to the individual user and initiating further transport of all documents contained in the collecting stacker into the output stacker in common. Since the successively printed documents are first collected in a collecting stacker and are only simultaneously transferred to the output stacker when the last document has been deposited therein, there is a far higher assurance that the user will take all documents intended for him before he leaves the device.

BRIEF DESCRIPTION OF THE DRAWINGS

An exemplary embodiment of the invention shall be set forth in greater detail below with reference to the drawings.

DESCRIPTION OF THE PREFERRED EMBODIMENTS

Figure 1:
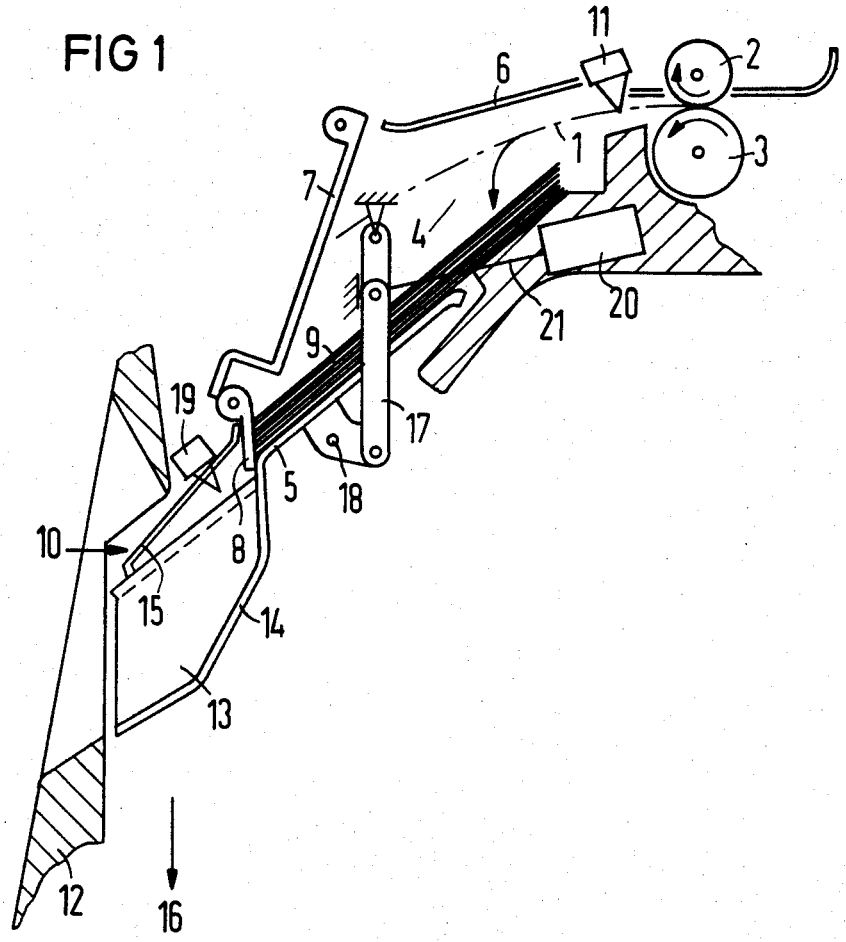
FIG. 1 is side sectional view of a document output device of the invention in the condition of intermediately storing the documents in a collecting stacker.

FIG. 1 shows a document output device as a component part of a printing mechanism (not shown in the drawing) for single document separated from a cross-perforated continuous-form paper web. After being separated, these single documents 1 are grasped by a roller pair 2, 3 and are subsequently supplied into a collecting stacker 4 where they are deposited stack-wise on an obliquely descending supporting surface 5. The upper limitation of the collecting stacker 4 is formed by two paper guidance elements 6, 7.

A retention mechanism in the form of two retention fingers 8 is also provided at the output of the collecting stacker 2, these being supported against a stepped edge of the supporting surface 5 in the closed condition and thus preventing a stack 9 of the documents from sliding further along the supporting surface 5 into a following output stacker 10 until all documents, for example statements of account, intended for the particular user have been printed and stacked in the collecting stacker 4. A light barrier or sensor 11 provided at the input of the collecting stacker 4 monitors the transport by the roller pair 2, 3 as well as the faultless separating or detaching of the documents.

At the far side of the retention mechanism formed by the two retention fingers 8, the collecting stacker 4 merges into the output stacker 10 which is accessible from the outside through an opening of a housing wall 12 of the printing mechanism. A recessed grip 13 which facilitates removal of the documents is also provided next to the end section of the supporting surface 5 extending into the output stacker 10. This recessed grip 13 is formed by a trough-like shoulder element 14 provided at the underside of the supporting surface 5, the edge of this shoulder element 14 pointing forward under the leading edge of the supporting surface 5 connecting flush to the lower limitation of the output stacker 10.

Figure 2:
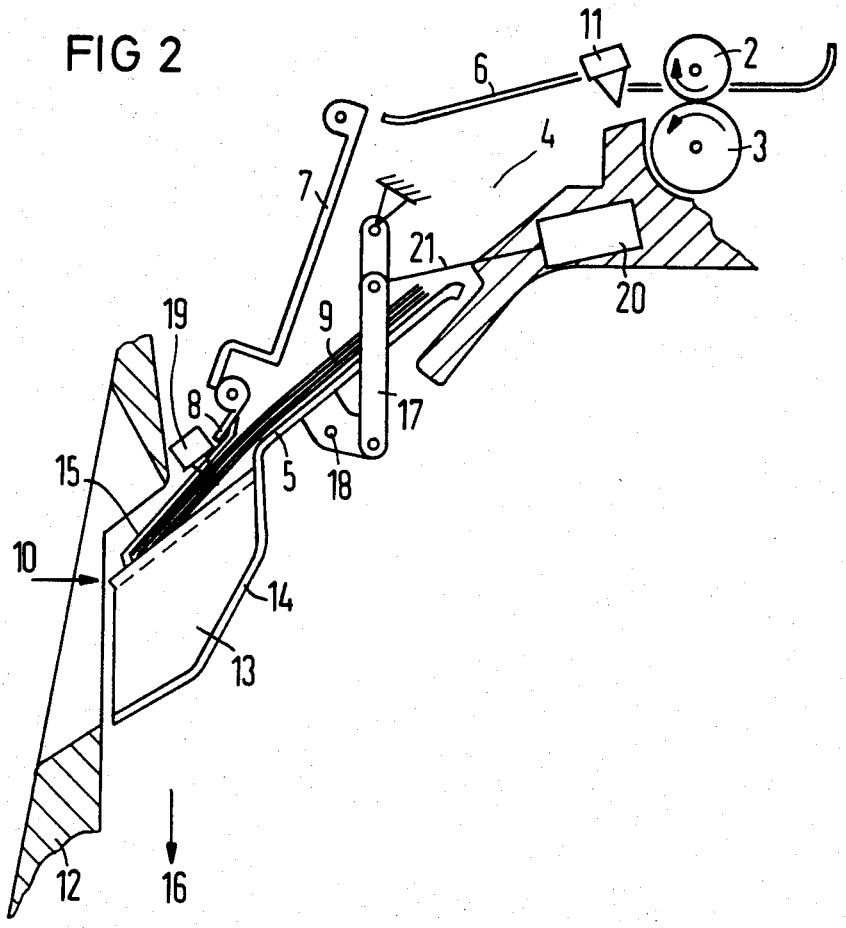
FIG. 2 is a side sectional view of the document output device of FIG. 1 illustrating further transport of the documents stacked in the collecting stacker into the output stacker.

FIG. 2 shows the arrangement of FIG. 1 showing an open collecting stacker 4, ie. when the retention fingers 8 are pivoted up. The consequence thereof is that the document stack 9 slides along the supporting surface 5 slopely down into the output stacker 10, is intercepted there by at least two braking elements 15 and is prevented from falling out of the output stacker 10. The braking elements 15 are comprised for example, of leaf springs secured at one end which are resiliently supported at their free ends angled off down toward the supporting surface 5. When the user reaches into the output stacker 10, by inserting a part of his hand into the recessed grip 13, he can then pull the document stack 9 from the supporting surface 5 by slightly lifting the leaf springs 15. The retention mechanism subsequently pivots back into its closing position.

In case the documents are not removed in due time, further transport into a deposit stacker 16 which is not accessible from the outside follows for reasons of data protection. To this end, the supporting surface 5 seated as a rocker is pivoted around a rotational axis 18 together with the recessed grip 13 via a bent lever mechanism 17, whereby the document stack 9, after being released by the leaf springs 15, falls into the deposit stacker 16 situated therebelow as a result of gravity. The maintenance personnel can remove the documents from here only after pivoting up the housing wall 12.

The sliding of the document stack 9 into the output stacker 10 after the retention fingers 8 have been opened, the removal of the documents by the customer, and, finally, whether the output stacker 10 is free of paper after the rocker has pivoted away and returned into its initial position are monitored via the light barrier or sensor 19 provided in the output stacker 10.

The pivot of the rocker is blocked by the bent lever 17 elongated in the output position. The rocker is thus prevented from being pivoted back from the outside and, thus, an unauthorized access into the deposit stacker 16 is prevented. The bent lever 17 is thereby held in an elongated position by a recuperating spring and by a detent. It is finally pivoted back into its initial position with the assistance of an electromagnet 20 comprising a tie bar 21.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. An output device in a printing mechanism for single documents separated from a perforated continuous-form paper web wherein the documents are transported into an output stacker after the printing and parting operation, the operation being enabled by user-associated authorization cards which are insertable into a badge reader, comprising: a collection stacker, which is not accessible from the exterior of said mechanism, for collecting all documents of a user preceding said output stacker, being situated above said output stacker, a retention mechanism provided at the output of said collecting stacker, a document supporting surface projecting into said output stacker and at least two braking elements resiliently supported on said supporting surface being provided in said collecting stacker, said retention mechanism being situated such at the output of said collecting stacker that said documents slide into said output stacker given an opened retention mechanism, said retention mechanism opening after the arrival of the last document with respect to the individual user and initiating further transport of all documents contained in said collecting stacker into said output stacker in common.

2. An output device according to claim 1, wherein said retention mechanism is composed of at least two rotatably seated retention fingers.

3. An output device according to claim 1, wherein said braking elements are fashioned as leaf springs.

4. An output device according to claim 1, wherein a light barrier signalling the presence of non-presence of one or more documents is provided in said output stacker.

5. An output device according to claim 1, wherein a cavity serving as a recessed grip is provided in said output stacker.

6. An output device according to claim 5, wherein a trough-like shoulder element serving as a recessed grip wall is provided at the underside of the end section of said supporting surface extending into said output stacker, the edge of said shoulder element pointing forward below the leading edge of said supporting surface connecting flush to the lower limitation of said output stacker.

7. An output device according to claim 6, wherein a deposit stacker which is not accessible from the outside is provided below said output stacker and said supporting surface together with recessed grip seated as a rocker can be moved back and forth between a document output position and a deposit position by means of a drive device, whereby an opening in said deposit stacker is released in said deposition position, the document stack falling into said opening after being released by said braking elements.

* * * * *